US008242867B2

(12) United States Patent
Greenway

(10) Patent No.: US 8,242,867 B2
(45) Date of Patent: Aug. 14, 2012

(54) HIGH SECURITY BALANCED MAGNETIC SWITCH

(75) Inventor: Warren Greenway, Pahoa, HI (US)

(73) Assignee: Royne Industries, LLC, La Jolla, CA (US)

( * ) Notice: Subject to any disclaimer, the term of this patent is extended or adjusted under 35 U.S.C. 154(b) by 246 days.

(21) Appl. No.: 12/749,460

(22) Filed: Mar. 29, 2010

(65) Prior Publication Data

US 2010/0245004 A1 Sep. 30, 2010

Related U.S. Application Data

(60) Provisional application No. 61/165,462, filed on Mar. 31, 2009.

(51) Int. Cl.
*H01H 9/00* (2006.01)

(52) U.S. Cl. ..... 335/207; 335/205; 335/206

(58) Field of Classification Search ..... 335/205–207, 335/219

See application file for complete search history.

(56) References Cited

U.S. PATENT DOCUMENTS

| | | | | | |
|---|---|---|---|---|---|
| 2,520,935 | A * | 9/1950 | Hubbell | 335/207 |
| 2,573,920 | A * | 11/1951 | McLeod | 200/51.09 |
| 2,877,361 | A * | 3/1959 | LeLand | 307/112 |
| 3,273,091 | A * | 9/1966 | Wales, Jr | 335/207 |
| 3,535,664 | A * | 10/1970 | Staar | 335/153 |
| 4,210,889 | A * | 7/1980 | Holce | 335/207 |
| 5,239,202 | A * | 8/1993 | Hostetler | 307/116 |
| 5,668,533 | A * | 9/1997 | Jackson et al. | 340/547 |
| 5,694,039 | A * | 12/1997 | Alfors | 324/207.2 |
| 5,698,909 | A * | 12/1997 | Miyazawa | 307/116 |
| 5,877,664 | A | 3/1999 | Jackson, Jr. | |
| 5,929,731 | A | 7/1999 | Jackson, Jr. | |
| 6,246,307 | B1 * | 6/2001 | Friedman | 335/205 |
| 7,187,259 | B1 * | 3/2007 | Habboosh | 335/205 |
| 7,248,136 | B2 | 7/2007 | Habboosh | |
| 2005/0110600 | A1 * | 5/2005 | Woods | 335/205 |

* cited by examiner

*Primary Examiner* — Mohamad Musleh

(74) *Attorney, Agent, or Firm* — Philip R. M. Hunt; Kurt M. Rylander

(57) ABSTRACT

An embodiment is a magnetic switch assembly generally comprising a switch base coupled to a switch housing. The switch base and switch housing may be coupled to, for example, a door frame or other substantially fixed location. Adjacent the switch base and switch housing may be an actuating magnet base including a plurality of actuating magnets. The proximity to or distance from the actuating magnets in the actuating magnet base may actuate magnets within the switch housing to open and/or close a circuit and/or otherwise generate a signal that may be communicated by an interface cable to, for example, a security system. The magnetic switch assembly of an embodiment may include one or more features that impede and/or substantially prevent tampering to defeat the magnetic switch assembly.

13 Claims, 3 Drawing Sheets

HIGH SECURITY BALANCED MAGNETIC SWITCH

CROSS-REFERENCE TO RELATED APPLICATION

This application claims priority to U.S. Provisional Patent Application Ser. No. 61/165,462 filed Mar. 31, 2009, which is incorporated herein by reference.

FIELD OF THE INVENTION

The present invention relates to a magnetic switch. More particularly, the present invention relates to tamper-resistant balanced magnetic switch.

BACKGROUND

Security systems and/or security alarm systems often use magnetic switches attached to doors, windows, and other structures to detect the unauthorized opening and/or manipulation of the door, window, or other structures. However, previous magnetic switch designs have been prone to tampering and/or have exhibited unacceptable reliability.

For example, one type of magnetic switch is a reed switch. However, these switches may be defeated by clever application of, for example, one or more external magnets. Specifically, a compact high energy magnet may be positioned in proximity to the reed switch to operate (to either open or close depending on the control scheme) the reed switch illicitly and/or without authorization. Once they have defeated the reed switch, an intruder may open and/or manipulate the door, window, or other structures without triggering the security system and/or security alarm systems.

Presently known art attempts to address this problem, but have not completely solved the problem. For example a number of magnetic switches have been proposed in the past to overcome the inherent limitation and serious deficiencies of reed switches. The following represents at least a partial list of known related art:

| Reference: | Issued to: | Date of Issue/Publication: |
|---|---|---|
| 5,877,664 | Jackson, Jr. | Mar. 2, 1999 |
| 5,929,731 | Jackson, Jr. | Jul. 27, 1999 |
| 7,248,136 B2 | Habboosh | Jul. 24, 2007 |

The teachings of each of the above-listed citations (which does not itself incorporate essential material by reference) are herein incorporated by reference. None of the above inventions and patents, taken either singularly or in combination, is seen to describe the instant invention as described and claimed.

U.S. Pat. No. 5,877,664 to Jackson, Jr. teaches a proximity switch system includes a switch portion, configured to connect and disconnect at least one electrical path, and a magnetically active actuator. The switch portion has a casing formed of a magnetically noninteracting material, at least one electrical contact disposed in the casing, a magnetically active armature member moveable along the casing between a first position and a second position, wherein the armature member contacts the electrical contact when in the first position to connect the at least one electrical path and the armature member being electrically isolated from the electric contact when in the second position to disconnect the at least one electrical path, and a magnetically active biasing member disposed in the casing, wherein the biasing member magnetically interacts with the armature member to bias the armature member in one of the first and second positions. The magnetically active actuator is movable with respect to the switch portion between proximal and distal positions. The actuator magnetically interacts with the armature member when in the proximal position to move the armature to the other one of the first and second positions, and at least one of the armature member and the biasing member include a magnet.

U.S. Pat. No. 5,929,731 to Jackson, Jr. teaches a balanced magnetically-actuated proximity switch assembly for use in a monitoring system that includes a switch assembly and an actuating assembly. The switch assembly has a plurality of magnetic switches with respective magnetic directionalities. The actuating assembly is movable relative to the switch assembly and has a plurality of magnets. Each one of the magnets produces a magnetic field corresponding to the magnetic directionality of a respective one of the magnetic switches.

U.S. Pat. No. 7,248,136 to Habboosh teaches a universal magnetic switching assembly for detecting relative movement between first and second members, the universal switching assembly including, a flux directing device for selectively directing a majority of applied magnetic flux, such that an externally applied magnetic field cannot be used to defeat the magnetic switch assembly. The magnetic switching assembly also including at least one tamper switch to detect application of an external magnetic field.

SUMMARY AND ADVANTAGES

The magnetic switch assembly of an embodiment of the present invention presents numerous advantages, including: (1) increased resistance to tampering by the introduction of one or more external magnets; (2) increased resistance to tampering by prying off and/or otherwise interfering with one or more portions of the magnetic switch assembly; (3) increased reliability by reducing contamination of internal components; (4) decreased contamination of internal components by the use of electronics-grade potting and/or encapsulation material; (5) increased reliability by utilizing passive circuit components; (6) increased electrical coupling of one or more magnets to one or more circuits by including a conductive coating on the magnets; and (7) increased electrical coupling of one or more magnets to one or more circuits by including self-cleaning rotation of the magnets.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

REFERENCE NUMBERS USED IN DRAWINGS

Figure 1:
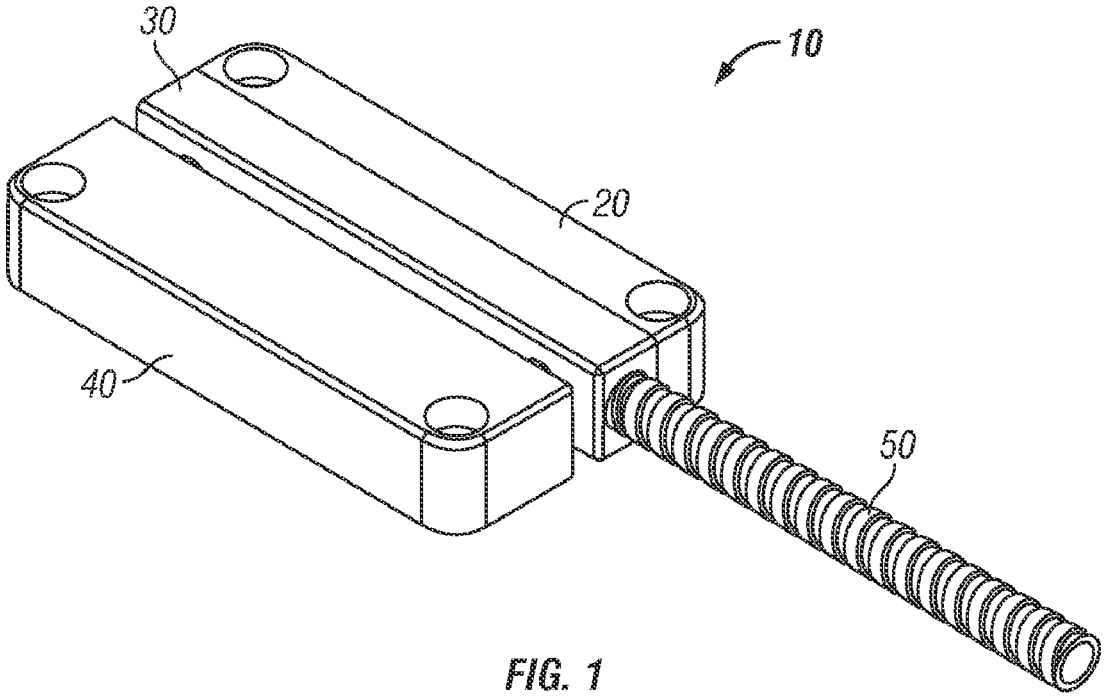
FIG. 1 shows the magnetic switch of an embodiment.

Turning now descriptively to the drawings, in which similar reference characters denote similar elements throughout the several views, the figures illustrate the magnetic switch assembly of an embodiment of the present invention. With regard to the reference numerals used, the following numbering is used throughout the various drawing figures:

10 magnetic switch assembly
20 switch base
22 lateral switch base magnet
24 center switch base magnet
26 tamper insert
27 tamper insert protrusion
28 tamper circuit
30 switch housing
32 switch circuit
34 armature block
36 lateral armature magnet
38 center armature magnet
40 activating magnet base
42 activating magnet
50 interface cable

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 2:
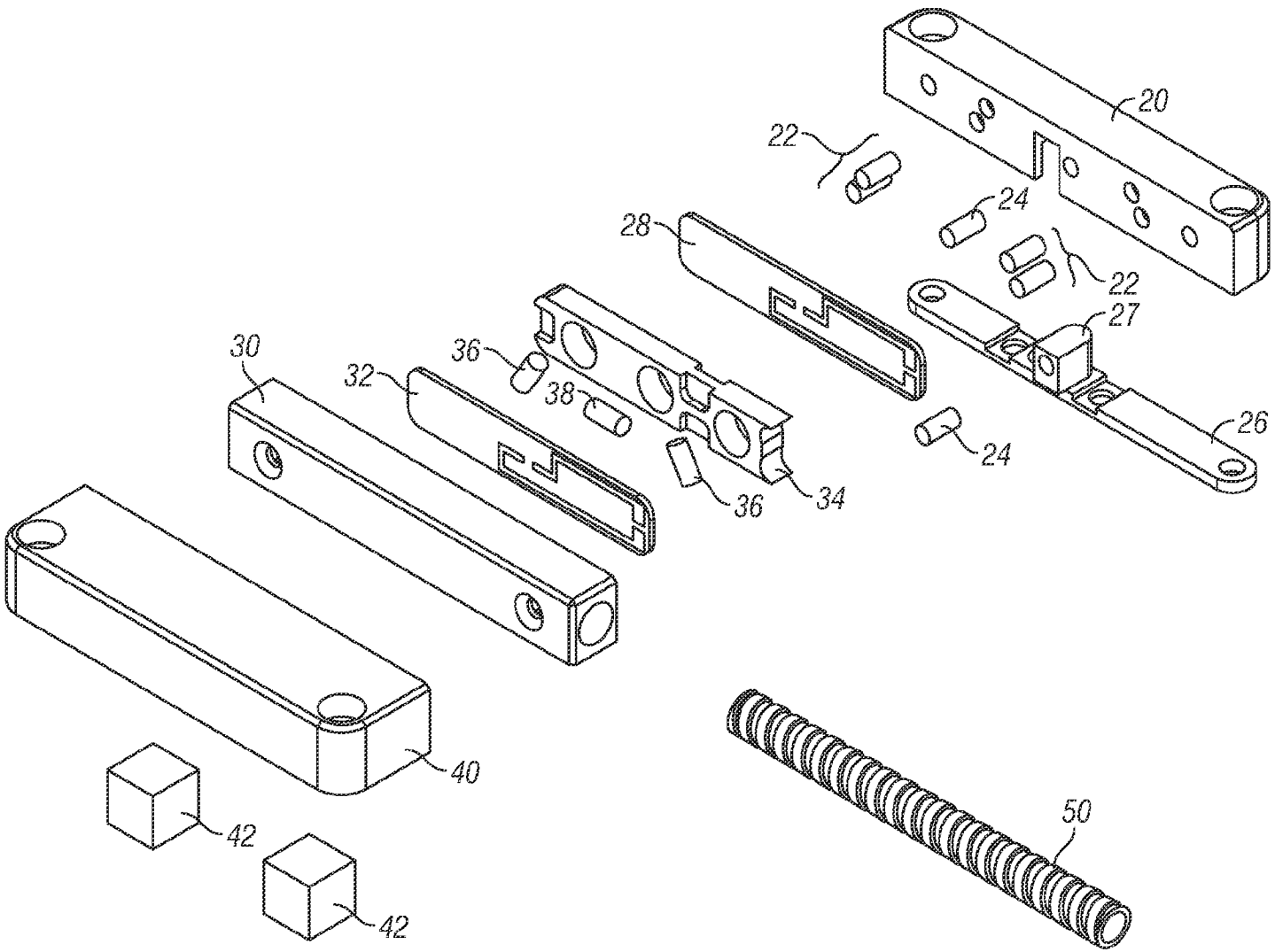
FIG. 2 shows an exploded view of the magnetic switch of an embodiment.
Figure 3:
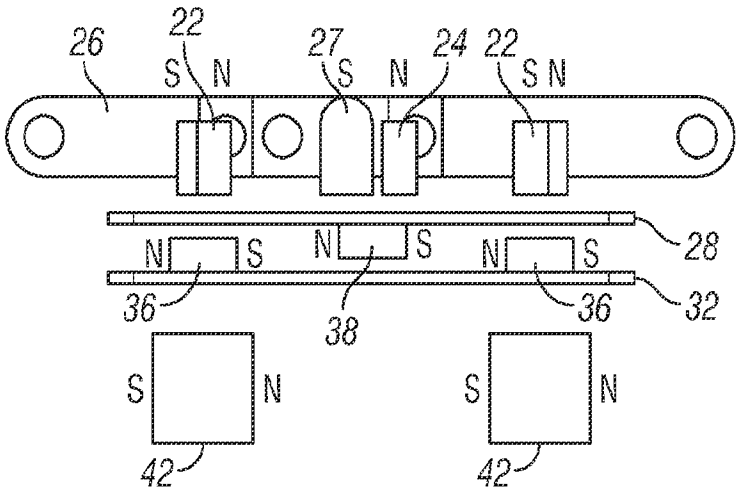
FIG. 3 shows an exploded view of the magnetic switch of an embodiment in an non-actuated configuration and an actuated configuration.
Figure 3:
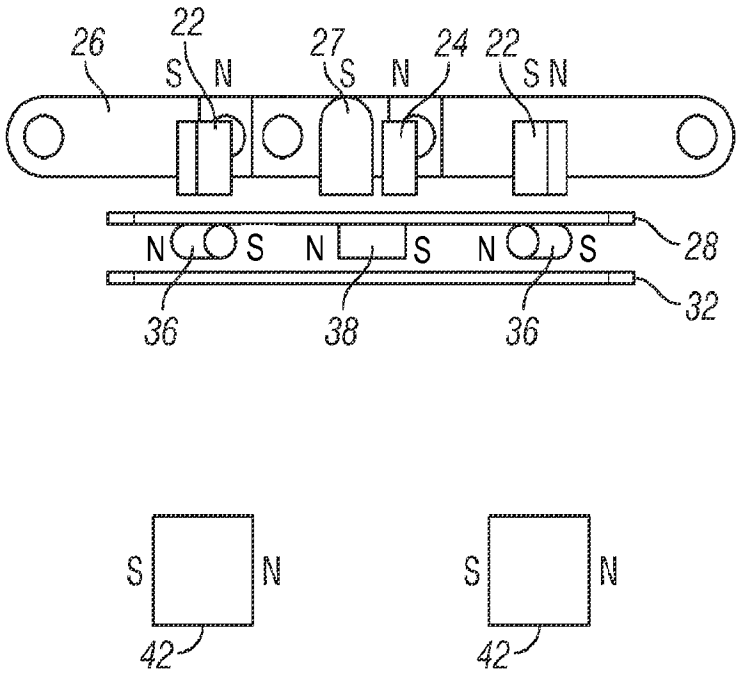

As shown in FIGS. 1-3, a magnetic switch assembly 10 is provided. As illustrated by FIG. 1, magnetic switch assembly 10 generally comprises a switch base 20 coupled to a switch housing 30. The switch base 20 and switch housing 30 may be coupled to, for example, a door frame or other substantially fixed location. Adjacent the switch base 20 and switch housing 30 may be an actuating magnet base 40 including a plurality of actuating magnets 42. The actuating magnet base 40 may be coupled to, for example, a door or other substantially mobile location adjacent to the switch base 20 and the switch housing 30. As will be explained in more detail with reference to FIGS. 2 and 3, the proximity to or distance from the actuating magnets 42 in the actuating magnet base 40 may actuate magnets within the switch housing 30 to open and/or close a circuit and/or otherwise generate a signal that may be communicated by the interface cable 50 to, for example, a security system (not illustrated) to detect whether the door is open or closed. As will further be explained by FIGS. 2 and 3, the magnetic switch assembly 10 of an embodiment may include one or more features that impede and/or substantially prevent tampering to defeat the magnetic switch assembly 10.

FIG. 2 illustrates an exploded view of the magnetic switch assembly 10 of an embodiment. The switch base 20 of an embodiment may include a tamper insert 26. The tamper insert 26 may include a plurality of holes or apertures through which screws or other attachment means may substantially secure the tamper insert 26 substantially directly to a door frame. The tamper insert 26 may include further holes or apertures through which the switch base 20 may be attached and/or otherwise substantially secured to the door frame over and substantially enclosing the tamper insert 26. The tamper insert 26 may include a tamper insert protrusion 27 to protrude into a cavity formed in and/or defined by the switch base 20 when the tamper insert 26 is coupled thereto.

The switch base 20 may further include a plurality of magnets. In an embodiment, the magnets are substantially cylinder shaped neodymium iron boron permanent magnets. More specifically, the switch base 20 may include four lateral switch base magnets 22 arranged in two pairs. Each pair of lateral switch base magnets 22 may be located approximately between the center of the tamper insert 26 and each lateral end of the tamper insert 26. Further, each pair of lateral switch base magnets 22 may define an oblique line relative to the edge of the switch base 20 that may mount to the door frame or the like. In an embodiment, each pair of lateral switch base magnets 22 may define an approximately forty-five degree angle relative to the edge of the switch base 20 that may mount to the door frame or the like. The lateral switch base magnets 22 may be substantially fixed within and/or secured by the switch base 20.

As noted, the tamper insert protrusion 27 may protrude into the switch base 20 when the switch base 20 is coupled to the tamper insert 26. In an embodiment, the tamper insert protrusion 27 may include a center switch base magnet 24. The switch base 20 may include a second center switch base magnet 24 adjacent to the tamper insert protrusion 27. The pair of center switch base magnets 24 may define a line that is substantially parallel to the edge of the switch base 20 that may mount to the door frame or the like. Further, the pair of center switch base magnets 24 may be located substantially at the center of the switch base 20. The center switch base magnets 24 may be substantially fixed within and/or secured by the switch base 20 and the tamper insert protrusion 27 respectively.

The tamper insert 26 of an embodiment may include portions that are designed to fail upon tampering with the switch base 20 and/or switch housing 30 coupled thereto. For example, adjacent to the holes or aperture through which the tamper insert 26 may be attached with screws or other attaching means to a door frame, the tamper insert 26 may include a thinner portion of tamper insert 26 material, one or more scores, one or more perforations, or any other feature designed to fail upon tampering. More specifically, should someone attempt to pry the switch base 20 and/or the switch housing 30 coupled thereto off of, for example, a door frame the tamper insert 26 will shear, break, or otherwise fail so that at least the portion of the tamper insert 26 including tamper insert protrusion 27 will remain substantially affixed to the door frame or the like. Accordingly, as the switch base 20 and/or the switch housing 30 are pried while the tamper insert protrusion remains coupled to the door frame, the pair of center switch base magnets 24 will no longer define a line that is substantially parallel to the edge of the switch base 20 that may mount to the door frame or the like.

FIG. 2 further illustrates the switch housing 30. In an embodiment, the switch housing houses and/or substantially encloses the tamper circuit 28, the armature block 34 defining at least three cavities therein, two lateral armature magnets 36, a center armature magnet 38, and a switch circuit 32. The switch housing 30 may couple to the switch base 20 to substantially enclose the tamper circuit 28, the armature block 34, the lateral armature magnets 36, the center armature magnet 40, and the switch circuit 32. The enclosure permits the lateral armature magnets 36 and the center armature magnet 38 to rotate substantially freely within the cavities and/or apertures formed in and/or defined by the armature block 34 to interact with the lateral switch base magnets 22, the center switch base magnets 24, and/or the actuating magnets 42.

The interaction between the lateral armature magnets 36 and the center armature magnet 38 with the lateral switch base magnets 22, the center switch base magnets 24, and the actuating magnets 42 may open and/or close a circuit and/or otherwise generate a signal that may be communicated by the interface cable 50 to, for example, a security system (not illustrated) to detect whether the door is open or closed. The configuration of the magnets within the switch base 20, the switch housing 30, and the actuating magnet base 40, may further impede and/or substantially prevent magnetic switch assembly 10 tampering by the introduction of one or more magnets external to the magnetic switch assembly 10.

More specifically, FIG. 3 illustrates the magnetic switch assembly 10 in both a non-actuated and an actuated configuration. In a non-actuated configuration (i.e., substantially in the absence of the actuating magnets 42), the lateral armature magnets 36 and the center armature magnet 38 interact substantially exclusively with both the lateral switch base magnets 22 and the center switch base magnets 24. For example, the lateral armature magnets 36 may interact with the lateral switch base magnets 22 while the center armature magnet 38 may interact with the center switch base magnets 24. In doing so, the longitudinal axes of the substantially cylinder shaped lateral armature magnets 36 may substantially mirror the oblique line (in an embodiment, an approximately forty-five degree line) defined by each pair of lateral switch base magnets 22. Further, the lateral armature magnets 36 may be generally attracted to the lateral switch base magnets 22 and may accordingly couple to the tamper circuit 28.

Further, the center armature magnet 38 may interact with the center switch base magnets 24. In doing so, the longitudinal axes of the substantially cylinder shaped center armature magnet 38 may substantially align with the parallel line defined by the pair of center switch base magnets 24. Further, the center armature magnet 38 may be generally attracted to the center switch base magnet 24 and may accordingly couple to the tamper circuit 28. The position and orientation of the lateral armature magnets 36 and the center armature magnet 38, and corresponding contact with one or more circuit elements and/or traces of tamper circuit 28, may open and/or close a circuit of tamper circuit 28 and/or otherwise generate a signal that may be detected by and/or communicated to, for example, a security system (not illustrated) via interface cable 50.

When the actuating magnet base 40 including actuating magnets 42 is within a particular actuation distance from and/or is substantially adjacent to the switch housing 30, the magnet switch assembly 10 will be in and/or convert to an actuated configuration. In an actuated configuration, the lateral armature magnets 36 interact with both the lateral switch base magnets 22 and the actuating magnets 42. As the actuating magnets 42 are stronger than the lateral switch base magnets 22, the lateral armature magnets 36 are attracted to the actuating magnets 42 more than they are attracted to the lateral switch base magnets 22. As a result, the lateral armature magnets both couple to the switch circuit 32 and rotate to substantially align with the poles of the actuating magnets 42. In an embodiment, when actuated, the lateral armature magnets 36 longitudinal axes may be substantially parallel to the edge of the switch base 20 that may mount to the door frame or the like.

Conversely, when actuated, the center armature magnet 38 may continue to interact with the center switch base magnets 24. In doing so, the longitudinal axes of the substantially cylinder shaped center armature magnet 38 may remain substantially aligned with the parallel line defined by the pair of center switch base magnets 24. Further, the center armature magnet 38 may remain generally attracted to the center switch base magnet 24 and may accordingly couple to the tamper circuit 28. While the magnetic switch assembly 10 is configured in the actuated configuration, the center armature magnet 38 may not couple to the switch circuit 32.

The position and orientation of the lateral armature magnets 36 and the center armature magnet 38, and corresponding contact with one or more circuit elements and/or traces of tamper circuit 28 and/or switch circuit 32 may further contribute to the tamper resistance of the magnetic switch assembly 10. For example, the particular positions and/or orientations of the lateral armature magnets 36 and the center armature magnet 38 in the non-actuated configuration compared to the actuated configuration may open and/or close one or more circuits of tamper circuit 28 and/or the switch circuit 32 and/or otherwise generate a signal indicative of the magnetic switch assembly 10 non-actuated or actuated configuration that may be detected by and/or communicated to, for example, a security system (not illustrated) via interface cable 50. The complexity of the magnetic interactions generated the non-actuated and actuated configurations of magnetic switch assembly 10 may increase the difficulty with which the magnetic interactions may be reproduced, for example by an external magnet or magnet assembly applied to the switch base 20 and/or the switch housing 30. More specifically, the complexity of the magnetic interactions generated by the non-actuated and actuated configurations of magnetic switch assembly 10 may increase the difficulty with the presence and/or proximity of the actuating magnet base 40 including actuating magnets 42 may be imitated and/or spoofed.

Further, as introduced, should someone attempt to pry the switch base 20 and/or the switch housing 30 coupled thereto off of, for example, a door frame the tamper insert 26 will shear, break, or otherwise fail so that at least the portion of the tamper insert 26 including tamper insert protrusion 27 will remain substantially affixed to the door frame or the like. Accordingly, as the switch base 20 and/or the switch housing 30 are pried while at least the tamper insert 26 portion including the tamper insert protrusion 27 remains coupled to the door frame, the pair of center switch base magnets 24 will no longer define a line that is substantially parallel to the edge of the switch base 20 that may mount to the door frame or the like. Accordingly, the center aperture magnet 38 may alter position and/or orientation, for example by rotating to remain aligned with the center switch base magnet 24 included in the switch base 20 and the center switch base magnet 24 that is included instead in the tamper insert protrusion 27. The alteration of the position and/or orientation of the center aperture magnet 38 may open and/or close one or more circuits of tamper circuit 28 or otherwise generate a signal indicative of the magnetic switch assembly 10 tampering that may be detected by and/or communicated to, for example, a security system (not illustrated) via interface cable 50.

The alteration of the position and/or orientation of the lateral aperture magnets 36 and center aperture magnet 38 to open and/or close one or more circuits of tamper circuit 28 and/or switch circuit 32 that may be detected by and/or communicated to, for example, a security system (not illustrated) via interface cable 50. To improve the electrical coupling, at least the lateral aperture magnets 36 and center aperture magnet 38 may include at least a conductive surface. For example, in an embodiment, the magnet lateral aperture magnets 36 and center aperture magnet 38 conducting surfaces may include gold conducting surfaces. Other materials in addition to and/or in lieu of gold may be coupled and/or applied to the conducting surfaces to increase the electrical coupling between the lateral aperture magnets 36 and center aperture magnet 38 with traces and/or other circuit elements of tamper circuit 28 and/or switch circuit 32.

To further increase the electrical coupling and/or reliability of the electrical coupling between lateral aperture magnets 36 and center aperture magnet 38 with traces and/or other circuit elements of tamper circuit 28 and/or switch circuit 32, the switch circuit 32, armature block 34 (including the lateral armature magnets 36 and the center armature magnet 38) and tamper circuit 28 may be coupled to and/or substantially secured in the switch housing 30 with an electronics-grade potting and/or encapsulation material. The electronics-grade potting, and/or encapsulation material may not substantially leech, outgas, and/or otherwise expel contamination that may interfere with the electrical coupling between the lateral aperture magnets 36 and center aperture magnet 38 with traces and/or other circuit elements of tamper circuit 28 and/or switch circuit 32.

The rotation of at least the lateral armature magnets 36 between the non-actuated and actuated configuration of magnetic switch assembly 10 may further increase the electrical coupling and/or reliability of the electrical coupling between lateral aperture magnets 36 with traces and/or other circuit elements of tamper circuit 28 and/or switch circuit 32. For example, the rotation of the lateral aperture magnets 36 may scrub and/or otherwise clean the traces and/or other circuit elements of tamper circuit 28 and/or switch circuit 32. Specifically, the rotation of the lateral aperture magnets 36 may scrub and/or otherwise clean debris, oxidation, and/or contamination from the traces and/or other circuit elements of tamper circuit 28 and/or switch circuit 32.

Though described with reference to a door and a door frame, it is to be understood that the magnetic switch assembly 10 of an embodiment may be used for any application to detect between two configurations provided one configuration positions the actuating magnet base 40 adjacent to the switch base 20 and the switch housing 30 and the other configuration positions the actuating magnet base 40 away from the switch base 20 and the switch housing 30.

In operation, the magnetic switch assembly 10 of an embodiment may be altered and/or actuated between a non-actuated and an actuated configuration by the introduction of the actuating magnet base 40 including actuating magnets 42 in proximity and/or adjacent to the switch base 20 and the switch housing 30. The actuation of switch assembly 10 includes attracting the lateral armature magnets 36 to the actuating magnets 42. In an embodiment, attracting the lateral armature magnets 36 to the actuating magnets 42 further includes rotating the lateral armature magnets 36. The attraction and rotation of the lateral armature magnets 36 may electrically couple the lateral armature magnets 36 to the switch circuit 32 and/or alter the switch circuit 32 response. The lateral armature magnets 36 may substantially simultaneously electrically decouple from the tamper circuit 28.

The non-actuation of switch assembly 10 includes removing the actuating magnet base 40 including the actuating magnets 42 so that the lateral switch base magnets 22 attract the lateral armature magnets 36. In an embodiment, attracting the lateral armature magnets 36 to the lateral switch base magnets 22 further includes rotating the lateral armature magnets 36. The attraction and rotation of the lateral armature magnets 36 may electrically couple the lateral armature magnets 36 to the tamper circuit 28 and/or alter the tamper circuit 28 response. The lateral armature magnets 36 may substantially simultaneously electrically decouple from the switch circuit 32.

During normal operation of the magnetic switch assembly 10 between actuated and non-actuated configurations, the center armature magnet 38 remains attracted by and oriented to the center switch base magnets 24. Accordingly, the center armature magnet further 38 remains electrically coupled to the tamper circuit 28. Upon tampering, for example by the introduction of one or more external magnets and/or prying the switch base 20 and the switch housing 30 from the door frame, the center armature magnet 38 may rotate and/or alter its position and/or orientation. Accordingly, upon tampering, the center armature magnet 38 may electrically decouple from the tamper circuit 28 and/or alter the tamper circuit 28 response.

For each of the above configurations, the tamper circuit 28, the switch circuit 32, and/or the responses thereof may be detected by, for example, a security system (not illustrated) coupled to the magnetic switch assembly 10 via interface cable 50. The security system may detect between the non-actuated and actuated configurations of the magnetic switch assembly 10 as well as the presence of tampering of the magnetic switch assembly 10. More specifically the interaction of the center armature magnet 38 with the center switch base magnets 22 may be detected by the tamper circuit 28 as described above. The interaction of the lateral armature magnets 36 with the lateral switch base magnets 22 and/or actuating magnets 42 may be detected by the tamper circuit 28, the switch circuit 32, and/or a combination thereof.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A magnetic switch assembly comprising:

a base including a plurality of base magnets;

a switch housing with a base side configured to couple to the base;

an armature block deposed within the switch housing, the armature block defining a plurality of cavities;

one or more armature magnets, each armature magnet with a longitudinal dimension greater than a transverse dimension, each armature magnet with a longitudinal axis and a transverse axis, each armature magnet with poles on the longitudinal axis, each armature magnet deposed within one of the plurality of cavities in the armature block and freely rotatable therein on its transverse axis; and a switch circuit deposed within the switch housing, the switch circuit with at least one gap, the gap configured to be closed when one of the armature magnets is in contact with the switch circuit in a specific position and orientation about its transverse axis.

2. The magnetic switch assembly of claim 1, wherein each of the cavities has a depth dimension perpendicular to the base side of the switch housing; and wherein the depth dimension of each of the cavities is greater than the transverse dimension of the armature magnet deposed therein.

3. The magnetic switch assembly of claim 2, wherein the armature block is deposed between the switch circuit and the base side of the switch housing; and wherein the switch circuit has a set of switch circuit elements configured to be closed by one of the armature magnets associated with the switch circuit when the one of the armature magnets associated with the switch circuit is more strongly attracted to one or more actuating magnets deposed adjacent to switch housing opposite the base side than to any other magnetic field source.

4. The magnetic switch assembly of claim 3, further comprising a tamper circuit deposed within the switch housing adjacent to the base side of the switch housing; and wherein the tamper circuit has a set of tamper circuit elements configured to be closed by one of the armature magnets associated with the tamper circuit when the one of the armature magnets associated with the tamper circuit is more strongly attracted to one or more of the base magnets than to any other magnetic field source.

5. The magnetic switch assembly of claim 4, further comprising an actuating magnet base with the one or more actuating magnets; and wherein the actuating magnet base is configured so that when the actuating magnet base is placed adjacent to the switch housing opposite the base side, then the one of the armature magnets associated with the switch circuit elements is more strongly attracted to the one or more actuating magnets than the base magnets, and the one of the armature magnets associated with the tamper circuit elements is more strongly attracted to the base magnets than the one or more actuating magnets.

6. The magnetic switch assembly of claim 1, wherein at least one of the armature magnets is a cylinder with a cylinder side and two cylinder ends and with the longitudinal axis intersecting both cylinder ends.

7. A magnetic switch assembly comprising:

a switch housing;

an armature block deposed within the switch housing, the armature block defining a cavity;

an armature magnet having a cylindrical shape with a cylinder side and two cylinder ends, the armature magnet with a longitudinal axis through the cylinder ends and a transverse axis, the armature magnet with poles at the cylinder ends, the armature magnet deposed within the cavity in the armature block and freely rotatable therein on its transverse axis; and a circuit deposed within the switch housing adjacent the armature block, the circuit with two circuit elements and an intervening gap between the two circuit elements, the intervening gap less than a maximum longitudinal dimension of the armature magnet.

8. The magnetic switch assembly of claim 7, wherein the intervening gap between the two circuit elements is greater than a minimum dimension of a contact area between the cylinder side of the armature magnet and the circuit.

9. The magnetic switch assembly of claim 7, wherein the switch housing has a bottom surface that is configured to be coupled to fixed object; and wherein the two circuit elements define a line that is parallel to the bottom surface of the switch housing.

10. The magnetic switch assembly of claim 9, further comprising a base configured to be coupled to a base side of the switch housing, the base with a base magnet; and wherein the base magnet is configured so that when the base is coupled to the base side of the switch housing, then the base magnet attracts the armature magnet towards a position and orientation about its transverse axis other than parallel to the bottom surface of the switch housing.

11. A magnetic switch assembly comprising:

a base configured to couple to a fixed object, comprising two tamper base magnets, the base with a removable tamper insert configured to couple separately to the fixed object, the tamper insert having one of the two tamper base magnets;

a switch housing with a base side configured to couple to the base, an actuator side opposite the base side and a switch housing bottom configured to couple to the fixed object;

an armature block deposed within the switch housing, the armature block defining one or more cavities;

one or more armature magnets, each armature magnet with a longitudinal dimension greater than a transverse dimension, each armature magnet with a longitudinal axis and a transverse axis, each armature magnet with poles on the longitudinal axis, each armature magnet deposed within one of the cavities in the armature block and freely rotatable therein on its transverse axis;

wherein one of the armature magnets is a tamper armature magnet;

a tamper circuit deposed between the base side and the armature block, the tamper circuit with two tamper elements with an intervening tamper element gap; and wherein the two tamper base magnets are configured so that when the base is coupled to the switch housing and the tamper insert has not been removed from the base, then the two base magnets attract the tamper armature magnet into a position and orientation about its transverse axis that closes the tamper element gap.

12. The magnetic switch assembly of claim 11, wherein the base further comprises two switch base magnets;

wherein one of the armature magnets is a switch armature magnet;

further comprising a switch circuit deposed between the actuator side and the armature block, the switch circuit with switch elements, the switch elements with an intervening switch element gap, the switch elements defining a line parallel to the switch housing bottom;

wherein the two switch base magnets are configured to attract the switch armature magnet into an orientation other than parallel to the switch housing bottom when the base is coupled to the switch housing; and further comprising an actuator with a switch side, the actuator having an actuator magnet configured so that when the switch side of the actuator is adjacent the actuator side of the switch housing the actuator magnet pulls the switch armature magnet into a position and orientation that closes the switch element gap and does not pull the tamper armature magnet away from the tamper element gap.

13. The magnetic switch assembly of claim 11, wherein the tamper elements define a line parallel to the switch housing bottom.

* * * * *